United States Patent [19]

Moruno

[11] Patent Number: 4,989,789

[45] Date of Patent: Feb. 5, 1991

[54] INJECTOR DEVICE FOR GASEOUS FLUID CARRIED LIQUIDS

[76] Inventor: Jose C. Moruno, C.Industria, 45, 08202 Sabadell (Barcelona), Spain

[21] Appl. No.: 380,857

[22] Filed: Jul. 17, 1989

[30] Foreign Application Priority Data

Jul. 18, 1988 [ES] Spain ..... 8802583

[51] Int. Cl.[5] ..... B05B 7/04

[52] U.S. Cl. ..... 239/433; 239/550

[58] Field of Search ..... 239/432, 433, 434.5, 239/550, 566

[56] References Cited

U.S. PATENT DOCUMENTS 4,555,059 11/1985 Collins et al. ..... 239/433

4,688,724 8/1987 Pal et al. ..... 239/434.5

*Primary Examiner*—Andres Kashnikow

*Assistant Examiner*—Karen B. Merritt

*Attorney, Agent, or Firm*—Steinberg & Raskin

[57] ABSTRACT

The pressure chamber has a nozzle (10) with the outlet orifice communicating with a hole (16) surrounding the nipple such that it forms an annular gap (25) through which the steam issues to thereby sweep the liquid which issues through the nipple. According to the invention, the end (22) of the nipple has a guiding surface (26) leading the liquid which issues through its orifice towards the annular gap (25) to improve its sweeping by the steam. The improvements include a configuration (7, 17, 20) for an exact centering of the nipple (18) as regards the hole (16) of the nozzle (10), for example an intermediate portion of a through hole (6;6*a* . . . 6*d*) receiving it, with respective cylindrical surfaces (20, 17) of the nipple (18) and the nozzle (10) fitting with the ends of the intermediate portion. The injector is preferentially applicable to machines for continuous treatment of sheet materials, for example fabrics.

4 Claims, 2 Drawing Sheets

INJECTOR DEVICE FOR GASEOUS FLUID CARRIED LIQUIDS

The present invention relates to an injector device intended for sweeping liquids by a pressurized gaseous fluid, for example steam, and projecting these liquids in the form of minute droplets, for example onto a surface which is conformed to receive such liquid.

Such device find a wide variety of uses in several technical fields, an example of which, cited but not restricting the invention thereto, is to be seen in several textile handlings in which a treatment agent which is liquid in its working environment is projected by means of a pressurized steam jet onto the surface of a fabric piece or the like which moves continuously past the injector device. In the following, aiming for simplicity, the expression "liquid" is intended to denote any fluid which is liquid in its working environments and which is to be projected by means of the injector device, whereas the expression "stream" will be used to indicate any fluid which is gaseous in its working environment and which can be used as a means for sweeping the projected liquid.

BACKGROUND OF THE INVENTION

A known injector device of this kind comprises a body endowed with a pressure chamber which is open at one of its ends, communicating with a steam inlet and from the bottom of which a liquid supplying nipple extends with its orifice communicating with a liquid inlet. The mouth of the pressure chamber has fitted therein a nozzle having an outlet orifice for the liquid-steam mixture and communicating with a hole which surrounds the nipple, thus forming an annular gap about the lateral surface of the nozzle. The steam stream issuing from this gap thus causes a Venturi effect which sweeps the liquid present in the nipple orifice.

In some applications, for example when this injector device is used in a machine for the treatment of textiles, the need arises for varying the flow rate of the delivered liquid, in order to meet the requirements of the treatment to be performed, by means of a corresponding variation of the pressure of the steam supplied to the pressure chamber.

It has been experienced, in practice, that the flow rate of the liquid supplied by this injector device is weakly sensitive to the pressure variations of the carrier steam. In other words, to attain the liquid flow rates that are necessary in some applications, it is necessary to generate high steam pressures which are incompatible with the structural features of the usual machines and steam supplying plants.

On the other hand, experience has demonstrated that this known injector device provides a correct admixture of the steam with the liquid only within very narrow limits of the steam pressure, which when the correct admixture is not obtained leads to an uneven liquid distribution within the projected jet, the more so in the case of nozzles having a slit shaped outlet orifice to give a jet in configuration of a flat fan.

DESCRIPTION OF THE INVENTION

According to the invention, in a device for injecting a steam carried liquid, of the above described kind, a guide surface is formed at the end of the liquid supplying nipple which extends from the border of the orifice of such nipple up to the border of the end of the nozzle this surface guiding the liquid issuing from the said orifice towards the annular gap formed between the nipple outer surface and the inner surface of the nozzle hole, in which gap the carrier steam circulates at a maximum velocity.

Therefore, the liquid supplied by the nipple distributes itself about all of the outer outline of same, where it is well admixed to all of the steam annular flow before reaching the injector nozzle delivery orifice.

Preferably, with a view to facilitating the manufacture of the nipple, the liquid guiding surface is formed as a conical surface extending with increasing diameter from the mouth of the nipple orifice and up to the border of the end of the nozzle.

According to another feature of the invention, means are foreseen for an exact centering and aligning of the nipple as regards the hole off the nozzle which receives it. This is important to preserve the invention's advantageous feature of a good distribution of the liquid flow supplied by the nipple to the annular steam flow circulating about this nipple within the nozzle hole. To this end, the device is made of a base body provided with a through hole having an intermediate cylindrical portion and two end portions of a greater diameter and formed with a screw thread. The nipple and the nozzle are formed of respective parts having corresponding cylindrical surfaces adapted to fit with the intermediate cylindrical surface of the hole, as well as screw threaded surfaces engaging the screw threaded surfaces of this hole, such that a pressure chamber is formed within the said intermediate cylindrical portion of the hole, between the facing ends of the nipple and the nozzle, and a liquid input chamber is formed between the nipple and the adjacent end of the through hole of the base body.

This arrangement allows the manufacture of arrays of any given number of injectors in a single base body provided with a plurality of through holes, each hole mounting an array of nipple and nozzle as defined above. The steam pressure chamber of all of the injectors are connected by radial ducts to a common steam feeding canal, and the liquid input chambers are joined to independent liquid inputs. This latter feature allows the feeding of several injector devices of the same body with different treatment liquids.

BRIEF DESCRIPTION OF THE DRAWINGS

The enclosed drawings show several preferred embodiments of carrying into practice the invention, by way of examples not restricting the scope of the same. In the said drawings.

DESCRIPTION OF PREFERRED EMBODIMENTS

Figure 1:
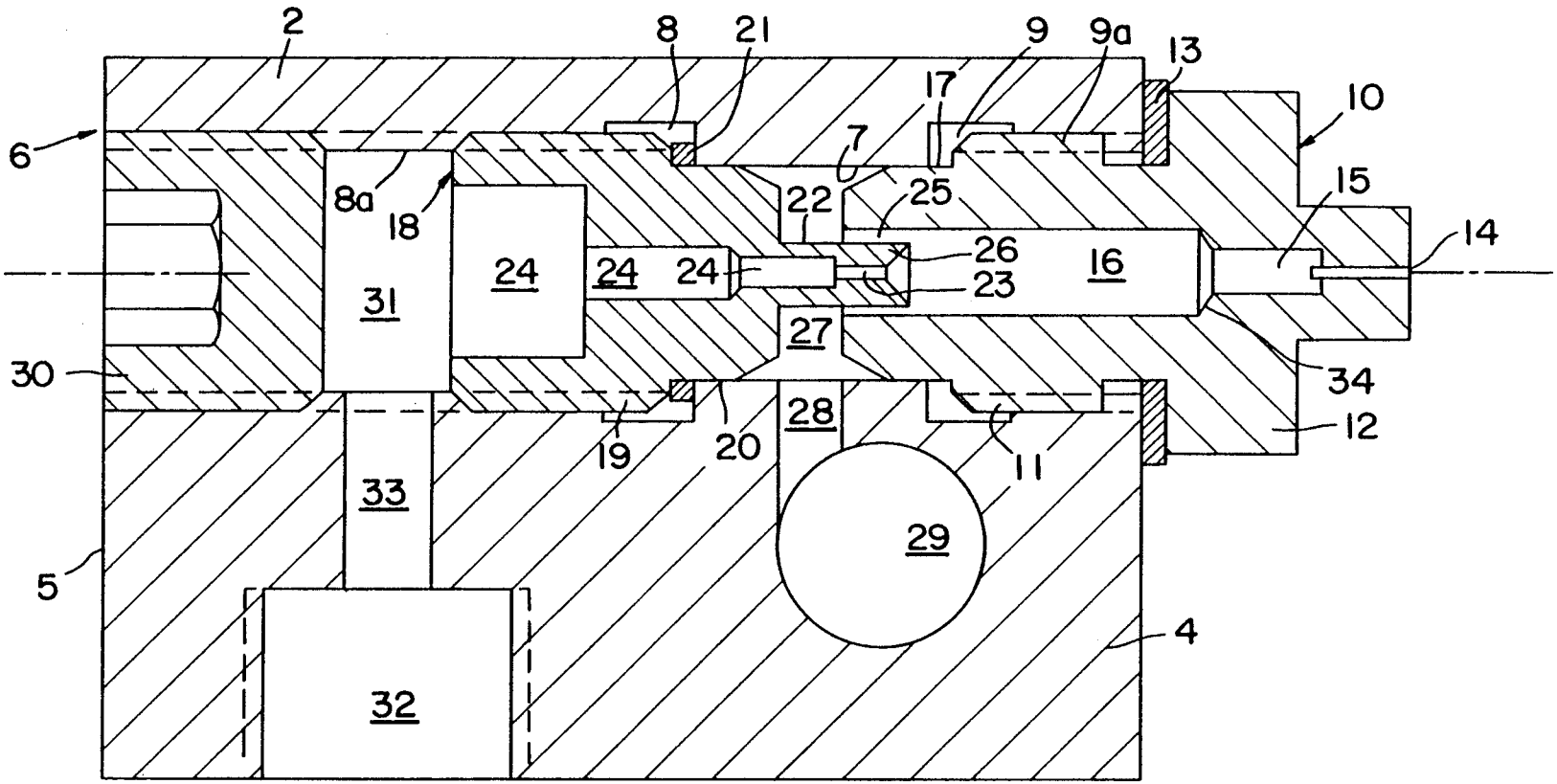
FIG. 1 is an axial section of an injector device according an embodiment of the invention, provided with a diametrical slit nozzle.

The main features of the injector device according to the invention are shown in FIG. 1. A base body indicated with the reference numeral 1 has a pair of upper and lower faces 2, 3 and a pair of front and rear faces 4, 5 mutually parallel within each pair, thus forming a block of rectangular cross section A drill hole, generally referred to as 6, is formed between the pair of front and rear faces 4, 5 of the body 1 and comprises three different longitudinal sections 7, 8, 9 of which the first, central section is thoroughly cylindrical, and the other two sections have respective screw threaded portions 8*a*, 9*a* opening to the outside of body 1 in the pair of faces respectively 5 and 4 of the body.

The hole section 9 mounts thereon a nozzle body generally referred to as 10, by means of a screw threaded portion 11 engaging with the screw thread 9*a* of body 1, and a conventionally faceted head 12 which rests onto the face 4 through a seal gasket 13. The nozzle has a diametric slit mouth 14 communicating with the inner hole 15 which widens forming a mixing chamber 16, and this latter opens at the inner end of the nozzle body 10. A terminal portion 17 of the nozzle 10, which is thoroughly cylindrical and coaxial with the center line of the nozzle body, coinciding in the Figure with the axis X—X of the hole 6, is formed between the inner end of the said nozzle body and the screw threaded portion 11 of it.

The diameter of the cylindrical surface 17 corresponds with the diameter of the central hole section 7, such that when the nozzle 10 is inserted along the hole 9 owing to the mutual engagement of the screw threads 9*a* and 11, both surfaces fitting with one another in sliding contact and the mixing chamber 16 becomes coaxial with the axis X—X of hole 6.

The nipple body, generally referred to as 18, has a portion of its length formed with a screw thread 19 engaging the inner screw thread 8*a* of the hole 8, and a cylindrical surface portion 20 fitting with the end of the cylindrical hole section 7 opposite to the mixing chamber 16 of the nozzle body 10 and, likes the said nozzle body 10, has a diameter corresponding with the cylindrical hole section 7, such that when the nipple 18 is inserted along the hole 8 owing to the engagement of the screw threads 19 and 8*a* with one another, these surfaces come into sliding contact and the nipple body 18 becomes coaxial with the axis X—X in its final, rest position onto the gasket 21.

The end of the nipple body 18 facing to the mixing chamber 16 has a terminal tenon 22 which is coaxial with the axis X—X and has a calibrated jet 23 as well coaxial with said axis and communicating with the apposite end of the nipple body 18 through a series of stepped up holes 24. The terminal tenon 22 has a diameter which is somewhat narrower than the mixing cavity 16, such that a passage gap or slit 25 is formed between the inner surface of the mixing cavity and the outer surface of the tenon 22. The end of the calibrated jet 23 opening in the mixing chamber 16 is flared in the shape of a conical surface 26 extending from the border of the jet 23 up to the border of the free end of tenon 22. All of this structure achieves a purpose to be described hereinafter.

Owing to the cylindrical surfaces 20 and 17, respectively of the nipple 18 and the nozzle 10, which are both coaxial with the axis X—X, fitting with the opposite ends of one and the same cylindrical hole which is also coaxial with the said axis X—X, the nipple tenon 22 and the mixing chamber 16 of the nozzle are accurately centered and aligned with one another, such that a quite constant passage section is ensured about all of the circumferential outline of the annular gap 25.

In the assembled position shown in FIG. 1, the ends of the nipple and nozzle 18 and 10 fitted in the opposite ends of the cylindrical hole section 7 and mutually faced, become placed at a given mutual distance and define a steam pressure chamber referred to as 27 and communicating with the mixing chamber 16 through the annular gap 25. This chamber communicates by means of a radial duct 28 with a steam inlet canal 29 extending through the body 1 in a direction which is at right angles to the drawings. On the other hand, the end of the nipper body 18 which is opposite to the nipple tenon 22 becomes located at a given distance from the opening of the screw threaded orifice 8*a* and this latter is closed in fluid impervious relation by means of a screw threaded plug 30, thus forming a liquid inlet chamber 31 communicating with a liquid input hole 32, formed on the lower face 3 of the body 1, by means of radial duct 33.

In the operation of the described injector device, the treatment liquid which the injector is designed project by means of the slit nozzle 10, is fed to the liquid chamber 31 through the ducts 32, 33 and comes through the hole 24 to the calibrated jet 23 to enter in the mixing chamber 16 and be swept by the carrying steam. This steam is fed at a pressure which is defined by the desired working conditions, through the ducts 29, 28 to the steam pressure chamber 27, from which it passes at a great velocity through the annular gap 25 towards the mixing chamber 16, from which it will be projected to the outside while it is sweeping a given flow of liquid through the hole 15 and the slit nozzle 14.

The steam stream issuing from the annular gap 25 gives a high velocity laminated flow running along the walls of the mixing chamber 16. The impack of this annular stream with the shoulder 34 which separates the mixing chamber 16 from the outlet hole 15, makes that a part of the fluidic flow which originates a central couterflow directed towards the mouth of the calibrated jet, where it is deflected radially outwardly that is, towards the annular gap 25. This outwardly directed flow draws the liquid issuing from the jet 23, along the conic surface 26 up to the annular gap 25, where the annular stream of high velocity steam circulates, such that the outwardly directed liquid is forced to come into direct contact with the steam, with no interposed inert, turbulent layers, and is swept by this latter in a close dependence on its velocity. This seems to explain the fact that in the injector device according to the invention it is possible to vary within wide limits the flow of swept liquid, by means of a variation of the steam pressure well within the limits of current technology.

It is clear that the conically shaped surface 26 must be regarded only as a nonrestrictive example, as it can, in practice, depart either in its generatrix outline or in its slope from the represented shape, for example by assuming a curved, concave shape. In a similar manner, the length of the mixing chamber as shown, can also be varied within wide limits, by suitably dimensioning the parts, according to desired aperating conditions and the physical features of the liquid agent which it is intended to project. On the other hand, whereas the above description has been focussed on an injector device provided with a nozzle orifice in the shape of a slit to give a flat fan shaped jet, it is obvious that the injector may have an orifice of any desired shape, according to the requirements of each use.

The described injector device may be used in an 30 integral form, that is, as a single injector to provide a single desired jet of liquid swept by steam or any fluid which is gaseous at the aperating conditions. However, in the described and shown embodiment, wherein the sweeping steam inlet canal 29 is located on a horizontal plane which is offset from the horizontal plane containing the axis of the hole 6 receiving the nipple 18 and nozzle 10, the injector device is specially well suited to be integrated in a battery comprising any desired number of injectors intended to cover with their jets a part, or the whole width, of a sheet material which is continuously moved past the said injectors, for example a continuous piece of textile material which is to be treated in its whole width, for dyeing, scouring or other conventional treatments.

Therefore, according to FIGS. 2 to 4, a prismatic block 1*a* having the same upper and lower faces 2, 3 and front and rear faces 4, 5 respectively, as described in connection with FIG. 1, is provided with a length, in the direction of the steam input canal 29 suitable to accommodate a given number of injector devices according to FIG. 3, in number four in the case shown.

To this end, the prismatic block 1*a* has four holes 6*a*, . . . 6*d* extending between its front and rear faces 4, 5, each of these holes having mounted therein an injector device formed of the nipple and nozzle bodies 18, 10 described in connection with FIG. 1. The steam input canal 29 extends along the block 1*a* on a horizontal plane located under the plane which is common to all of the holes 6*a*, . . . 6*d* and communicates with each of these holes, as previously described, by means of respective radial steam ducts 28*a*, . . . 28*d*. A radial duct 34 communicates the steam input canal 29 with a junction member 35 protruding from the lower face 3 of block 1*a* and is intended to connect the array to a conventional steam supply. On the other hand, the liquid input ducts 32*a*, . . . 32*d* open on the same lower face 3 of block 1, as described in connection with FIG. 1. The holes 36 which can be seen at the upper portion of FIGS. 2 and 3 are merely for manufacturing purposes and are intended to permit the holes 28 to be drilled; thereafter these holes are closed by conventional means (plug, pressure driven ball, welding, and so on).

The geometric arrangement of the holes 6 in the block 1*a* may be according to usual standards, for example such that the jets projected by the respective injector devices cover all of the battery length, or they intermix in a desired fashion on the application surface. In the embodiment shown it is assumed that all of the holes 6 are comprised within one and the same plane such that the axis of the projected jets are likewise coplanar. However, well within the scope of the invention, different arrangements could be foreseen, for example by locating the holes 6 in an alternate arrangement on different, vertically offset planes, for example in an amount suitable for the flat fan shaped jets to become mutually overlapped with no interference with one another.

Figure 2:
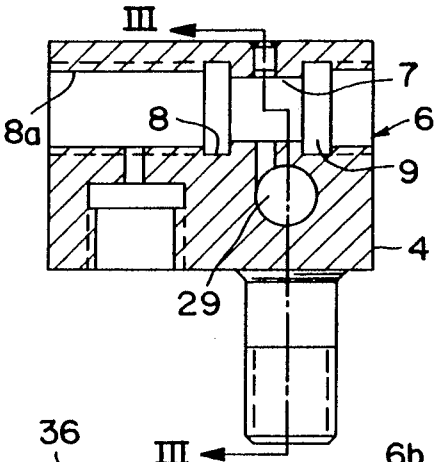
FIG. 2 is a similar view of the device body in another embodiment designed to form a support block for a four injector battery.
Figure 3:
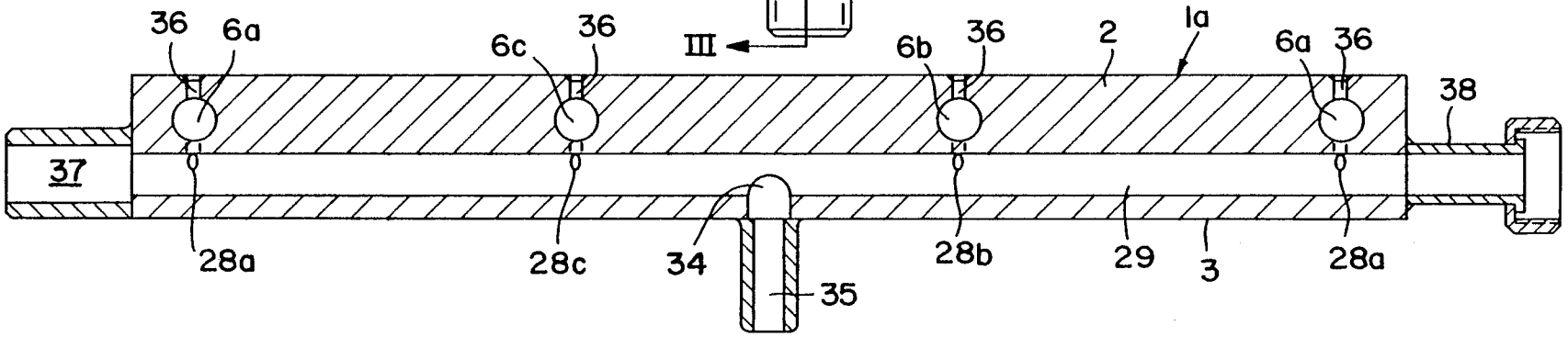
FIG. 3 is a longitudinal section of the block of FIG. 2, according to the line III—III of the same FIGURE.
Figure 4:
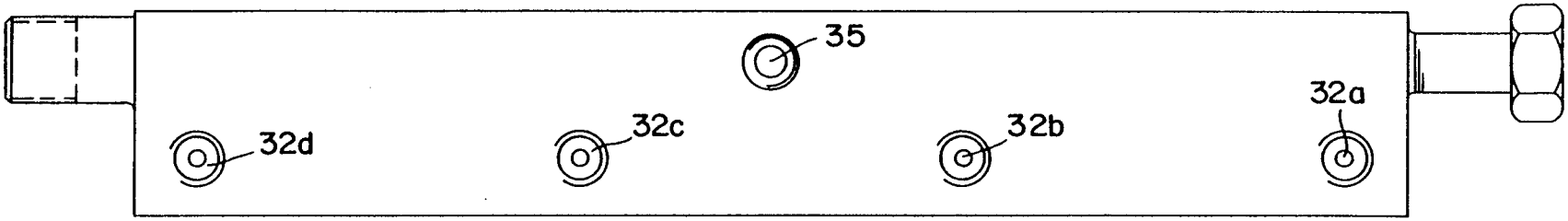
FIG. 4 is a plan view from the underside of the block of FIGS. 2 and 3.

According to the description of the injector device based on FIG. 1, it is possible to vary the flow rate of liquid supplied by the four injector devices of FIGS. 2 to 4, by means of a simple variation of the pressure of the steam input at the same time to the four pressure chamber 27. As to the feed of the liquid input chamber 31, it is obvious that the same common manifold 29 arrangement used in the case of steam, could be used, though the individual arrangement shown, with independent liquid input ducts 32, disclose additional advantages of the invention. Thus, for example, one or several liquid feed ducts 32 of the injector devices of FIGS. 2 to 4, could be fed with a different liquid according to the needs of each particular case of application. On the other hand, the independent liquid feed to the several injector devices allows for varying the feed pressure of either liquid as regards the other, such that individual variations can be introduced in the liquid flow rates already generally regulated by the steam pressure variations.

For manufacturing reasons it is desirable, from a given number of injectors higher to restrict the length of the blocks 1*a* to, for example, four injectors as shown, in which case the desired number of four injector batteries will be installed one adjacent the other, to cover the foreseen treatment width. All of the connection members 35 can be joined in a conventional manner to complementary connection members of a steam feed mains, not shown. If it is necessary to produce a particularly good uniformity of the steam input pressure to all of the injectors, compensating ducts can be provided between the batteries, for example, as shown in FIGS. 3 and 4, by endowing the opposite ends of the steam canal 29 with complementary connecting members 37, 38 such that all of the batteries in a series can be joined to form a common feed mains. Of course, other combinations, which are assumed to be obvious to those skilled in the art, are possible.

I claim:

1. An injector device for gaseous fluid carried liquids, of the type comprising a body (1) endowed with a pressure chamber (27) which is open at one of its ends, communicating with a steam inlet (29) and from the bottom of which a liquid supplying nipple (22) extends, with its orifice (23) communicating with a liquid inlet (32), the mouth of the pressure chamber having fitted therein a nozzle (10) having the outlet orifice (14) for the liquid-steam mixture and communicating with a hole (16) which surrounds the nipple (22) thus forming an annular gap (25) about the lateral surface of the same, the steam stream issuing from this gap thus originating a Venturi effect which sweeps the liquid present in the nipple orifice, and comprising a guide surface (26) formed at the end of the liquid supplying nipple (22) extending from the border of the orifice (23) of such nipple up to the border of the end of the same, this surface guiding the liquid issuing from the said orifice (23) towards the annular gap (25) formed between the outer surface of the nipple (22) and the inner surface of the nozzle hole (16), in which gap (25) the carrier steam circulates at a maximum velocity and comprising the device being made of a base body (1;1*a*) provided with a through hole (6;6*a*, . . . 6*d*) having an intermediate cylindrical portion (7) and two end portions (8*a*, 9*a*) of a greater diameter and formed with a screw thread, the nipple (18) and the nozzle (10) being formed of respective parts having corresponding cylindrical surfaces (20, 17) adapted to fit with the intermediate cylindrical surface (7) of the hole (6;6*a*, . . . 6*d*), as well as screw threaded surfaces (19, 11) engaging the screw threaded surfaces (8*a*, 9*a*) of this hole, the pressure chamber (27) being formed within the said intermediate cylindrical portion (7) of the hole, between the facing ends of the nipple (18) and the nozzle (10), and the liquid input chamber (31) between the nipple (18) and the adjacent end of the through hole (6;6*a*, . . . 6*d*) of the base body (1;1*a*).

2. An injector device according to claim 1, characterized in that the liquid guiding surface is formed as a conical surface (26) extending with increasing diameter from the mouth of the nipple orifice (23) and up to the border of the end of same.

3. An injector device according to claim 1, characterized in that the device comprises means (7,17,20) for an exact centering and aligning of the nipple (18) as regards the hole (16) of the nozzle (10) which receives it.

4. An injector device according to claim 1, characterized in that the device comprises a single base body (1*a*) provided with a plurality of through holes (6;6*a*, . . . 6*d*), each hole mounting an ensemble of nipple (18) and nozzle (10) as defined above, the steam pressure chamber (27) of all of the devices being connected by radial ducts (28*a*, . . . 28*d*) to a common steam feeding canal (29), and the liquid input chambers (31) are joined to independent liquid inputs (33), to feed several injector devices of the same body (1*a*) with different treatment liquids.

* * * * *